United States Patent [19]

Smith

[11] 4,443,804

[45] Apr. 17, 1984

[54] MODIFIED DIFFERENCE MODE COAXIAL ANTENNA WITH FLARED APERTURE

[75] Inventor: Terry M. Smith, La Honda, Calif.

[73] Assignee: Ford Aerospace & Communications Corporation, Detroit, Mich.

[21] Appl. No.: 306,058

[22] Filed: Sep. 28, 1981

[51] Int. Cl.[3] ..... H01Q 13/02

[52] U.S. Cl. ..... 343/786; 343/769

[58] Field of Search ..... 343/768, 769, 786

[56] References Cited

U.S. PATENT DOCUMENTS

| | | | |
|---|---|---|---|
| 3,508,277 | 4/1970 | Ware et al. . | |
| 3,581,311 | 5/1971 | Kach . | |
| 3,665,481 | 5/1972 | Low et al. . | |
| 3,739,386 | 6/1973 | Jones, Jr. . | |
| 3,864,687 | 2/1975 | Walters et al. . | |
| 3,918,064 | 11/1975 | Gustincic | 343/786 |
| 4,041,499 | 8/1977 | Liu et al. . | |
| 4,110,751 | 8/1978 | Reggia et al. . | |

*Primary Examiner*—Eli Lieberman

*Attorney, Agent, or Firm*—Edward J. Radlo; Robert D. Sanborn

[57] ABSTRACT

A coaxial radiating waveguide antenna is disclosed, comprising two conductive concentric right circular cylinders forming a cavity. Equally spaced within the cavity is a set of probes phased in such a manner as to produce $TE_{21}$ or a higher order difference mode of radiation. One side of the toroidal antenna is sealed by a flat conductive ring; the other side is generally open and terminates in two flared regions which serve to shape the beam in the desired fashion. A broad null surrounds the boresight axis with major lobes disposed approximately 45° therefrom in the case of $TE_{31}$ propagation. The resulting radiation can be circularly or linearly polarized.

8 Claims, 6 Drawing Figures

MODIFIED DIFFERENCE MODE COAXIAL ANTENNA WITH FLARED APERTURE

The U.S. Government has a paid-up license in this invention and the right in limited circumstances to require the patent owner to license others on reasonable terms as provided for by the terms of Contract No. F04701-76-C-0060 awarded by the Air Force.

BACKGROUND OF THE INVENTION

1. Field of the Invention

This invention pertains to the field of antennas for electromagnetic radiation. In particular, it is an antenna having coaxial radiating elements with applicability to spacecraft and other devices where a well defined null in the radiation pattern is desired.

2. Description of the Prior Art

A prior art search uncovered the following U.S. patent references:

U.S. Pat. No. 4,041,499 is a tracking feed antenna employing $TE_{21}$ mode (FIGS. 3*b* and 6) and $TE_{11}$ mode only. The $TE_{11}$ mode produces no null (FIG. 4*a*) while the $TE_{21}$ mode produces only a narrow null (FIG. 4*b*). While the present invention can be configured to operate in the $TE_{21}$ mode, it finds its greatest applicability in the $TE_{31}$ and higher order modes, where broader nulls can be realized. Further, the '499 patent does not show flared ends on its radiating elements, as in the present invention. A null is not deliberately formed and shaped as in the present invention. Additionally, the '499 patent uses dielectric 38 within the cavity for other than mechanical reasons, unlike the present invention's strictly mechanical use of dielectric.

U.S. Pat. No. 3,864,687 operates only in the $TE_{21}$ mode and does not disclose flares.

U.S. Pat. No. 3,665,481 operates only in the $TE_{11}$ and $TM_{01}$ modes.

U.S. Pat. No. 3,581,311 operates only in the $TE_{11}$ and TEM modes and does not disclose flares.

U.S. Pat. No. 3,508,277 operates only in the $H_{11}$ mode.

Secondary references are U.S. Pat. Nos. 3,739,386 and 4,110,751.

The present invention differs from all of the above references in that it is the only device showing operation at $TE_{31}$ and higher order difference modes in a coaxial antenna. Further, it is the only device showing operation in the $TE_{21}$ and higher order difference modes with a flared radiating element design, thus permitting deliberate null shaping.

SUMMARY OF THE INVENTION

The present invention is designed to achieve a radiation pattern exhibiting a shapably broad and deep null along the boresight axis of the antenna with prominent broad conical lobes, situated approximately 45° with respect to the boresight axis in the case of $TE_{31}$ radiation.

The antenna is fabricated of two concentric right circular cylinders sealed on one end by a conductive ring, and open on the other end in the form of outwardly flaring regions. Disposed within the cavity formed by the two concentric cylinders is a set of probes supported on dielectric members. The probes are equally spaced within the cavity and are excited to form a $TE_{21}$, $TE_{31}$, or higher order difference mode within the cavity. The probes can be phased and arranged so as to produce either circular polarization or linear polarization. If circular, the polarization can be left hand or right hand.

Each probe consists of a capacitive matching portion and a radiating member, each of which are thin, electrically conductive, and lie in a plane orthogonal to each of the two cylinders.

The height and width of the cavity and the angle and length of each flare determine the radiation pattern of the antenna. In an illustrative embodiment it was desired to produce a null at least 28° wide and to have this null be greater than 15 dB down in power from the levels of the broad lobes, whose maxima are situated approximately 45° with respect to the boresight axis. An antenna as described herein accomplished this feat over an 11% bandwidth.

An antenna so described has applicability in a spacecraft, for example, when one can illuminate other spacecraft with the broad lobes for communication therewith, and point the null toward the earth so as to provide privacy with respect to signals emanating from the earth.

BRIEF DESCRIPTION OF THE DRAWINGS

These and other more detailed and specific objects and features of the present invention are more fully disclosed in the following specification, reference being had to the accompanying drawings, in which:

FIG. 2(*b*) is a block diagram of a feed network which produces the phasing shown in FIG. 2(*a*);

DESCRIPTION OF THE PREFERRED EMBODIMENTS

Figure 1:
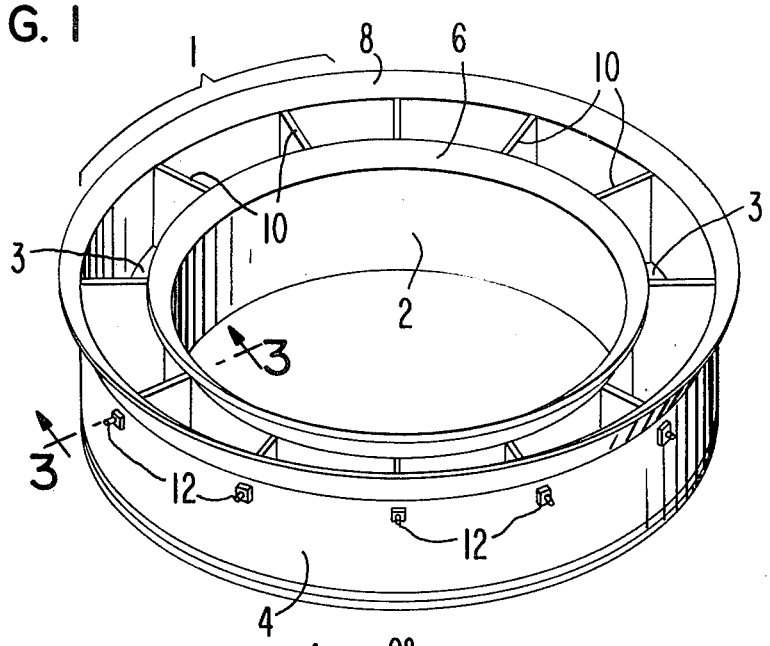
FIG. 1 is an elevational view of a preferred embodiment of the present invention, showing circular polarization in the $TE_{31}$ mode.

FIG. 1 illustrates a preferred embodiment of the present antenna 1. Concentrically disposed are two electrically conductive right circular cylinders, inner cylinder 2 and outer cylinder 4, forming a generally toroidal cavity therebetween. One end of the cavity (the bottom in FIG. 1) is sealed by means of electrically conductive circular flat ring 3. The other end of the cavity is left open and terminates in two outwardly flaring regions, inner flare 6, which is a continuation of inner cylinder 2, and outer flare 8, which is a continuation of outer cylinder 4.

Disposed within the cavity is a series of flat dielectric members 10, equally spaced from each other within the cavity, and each of which is orthogonal to each of the cylinders 2 and 4. On each dielectric member 10 is a probe described further hereinbelow, which serves to excite electromagnetic radiation within the cavity.

The function of each dielectric member 10 is to provide mechanical support for its associated probe. It is desired to minimize the impact of dielectric members 10 on the electrical properties of the antenna. Thus, each dielectric 10 should be just thick enough to provide structural rigidity, have low loss, and have low dielectric constant.

Each probe connects with a feed network external to antenna 1 via a feedthrough device 12 such as a coaxial bulkhead, situated near the flared end of each dielectric 10.

All of the feedthroughs 12 are depicted as being through outer cylinder 4, i.e., along the outside of antenna 1. Alternatively, all the feedthroughs 12 could be situated through inner cylinder 2, i.e., along the inside of antenna 1. In either case, they are all on one cylinder or the other so as to preserve phase integrity. If some were on the inner cylinder and some were on the outer, phase shifters would have to be employed to maintain phase integrity.

The cavity is excited with a $TE_{nm}$ difference mode, where n is a positive integer greater than or equal to 2 and m=1. For broad nulls, n must be greater than or equal to 3. The E vector is always orthogonal to each of cylinders 2 and 4.

In order to support a $TE_{n1}$ mode, the mean diameter of antenna 1 (defined as the average of the diameters of cylinders 2 and 4 in a plane orthogonal to each of the cylinders) must be at least $nL/\pi$. As used throughout this specification, L signifies the free space wavelength of the electromagnetic radiation propagated by the antenna of the present invention.

For the $TE_{n1}$ mode, the phase vector which represents the phase of the sinusoidal radiation fed at feedpoints 12 rotates through n complete revolutions as one undergoes one spatial revolution within the cavity. For the example illustrated, n=3, and thus it can be seen in FIG. 2(*a*) that as one rotates within the cavity in a clockwise direction, the phase (represented by angular notations next to each feedpoint) revolves from 0° through 360° three complete times.

Another constraint for $TE_{n1}$ mode is that cylinders 2 and 4 must be spaced less than L apart.

According to the principles of this invention, antenna 1 can be energized for circular polarization (left hand or right hand) or linear polarization. For circular polarization, the number of probes must be at least 4n; the probes are equally spaced around the cavity; and the phase increment is constant from each probe to the next probe. Thus, when 4n probes are used, as illustrated in the figures, the phases are incremented in a quadrature fashion, i.e., the phase at each probe is 90° in advance of the phase at the preceding probe.

For linear polarization, the number of probes must be at least 2n; the probes are equally spaced around the cavity; and the phase increment is constant from each probe to the next probe. Thus, when 2n probes are used, the phases are incremented in a 180° fashion.

It can be seen that for a given value of n, a set of circular polarization probes can be designed that is equivalent to two sets of linear polarization probes driven 90 electrical degrees apart.

The figures illustrate the embodiment where twelve equally spaced probes are used to excite a circularly polarized $TE_{31}$ mode.

Figure 2A:
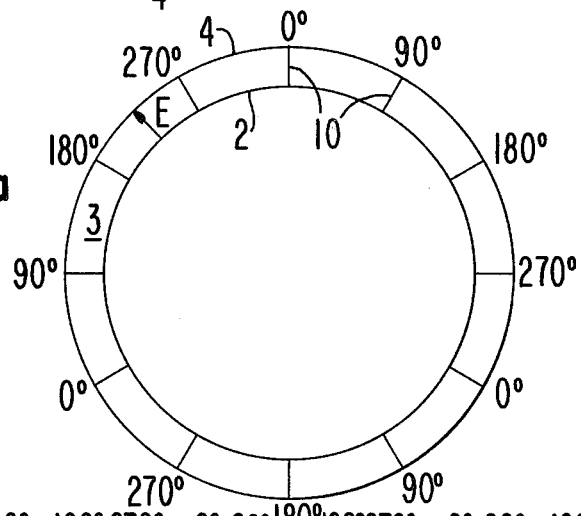
FIG. 2(*a*) is a simplified top view of the antenna depicted in FIG. 1.
Figure 2B:
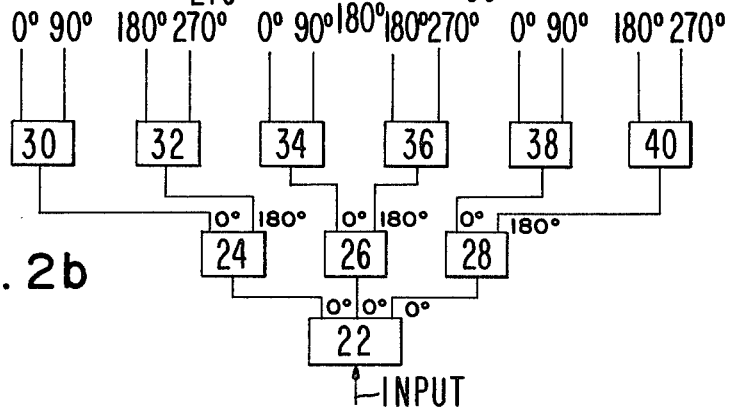

It is often desirable to preserve circular symmetry in the radiation pattern of the antenna, i.e., produce the same radiation pattern at any angular position within the plane of FIG. 2(*a*), angular position being taken from the centers of circles 2 and 4. Such a result is achieved by insuring that the power applied at each probe is equal to the power applied at all other probes. This can be accomplished by the feed network of FIG. 2(*b*) as one example. The power desired to be radiated by antenna 1 is fed as an input to three-way power divider 22, which divides the power equally three ways, while preserving the phase among the three outputs. The three outputs of divider 22 are fed as inputs, one to each of power dividers 24, 25, and 28, respectively. Each of dividers 24, 26, and 28 equally divides the input power applied at an input port into two outputs 180° out of phase from each other. When devices 24, 26, and 28 are magic T's, their inputs are fed at the difference port of each.

The six outputs of dividers 24, 26, and 28 are fed as one input to each of guadrature 3 db power dividers 30, 32, 34, 36, 38, and 40, respectively, each of which equally divides the input power applied to it and produces two outputs 90° out of phase from each other as shown.

The normal direction of radiation of antenna 1 is in the direction from the closed to the open end of the cavity and generally parallel to the boresight axis. The boresight or boresight axis is defined as the axis of revolution of each of cylinders 2 and 4. Assuming that flares 6 and 8 face out of the page in FIG. 2(*a*), that figure depicts right hand circular polarization because the direction of propagation is out of the page and the E-vector rotates in a counter-clockwise direction; thus, the right hand rule is satisfied. If the E-vector rotated in a clockwise direction, left hand circular polarization would ensue.

Figure 3:
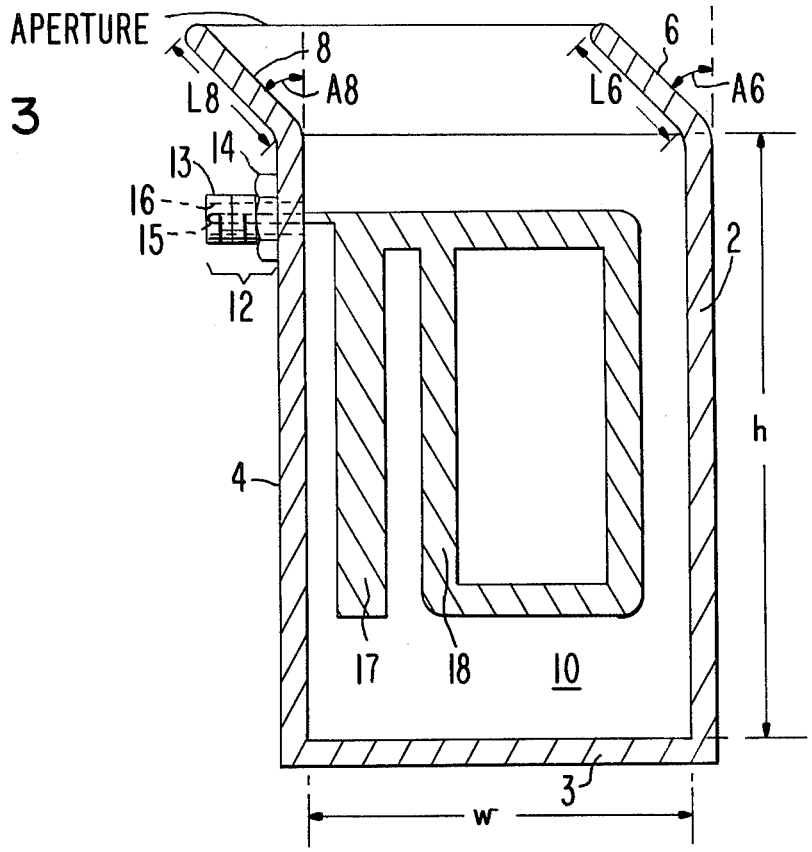
FIG. 3 is a side view of a probe suitable for use in FIG. 1.
Figure 5:
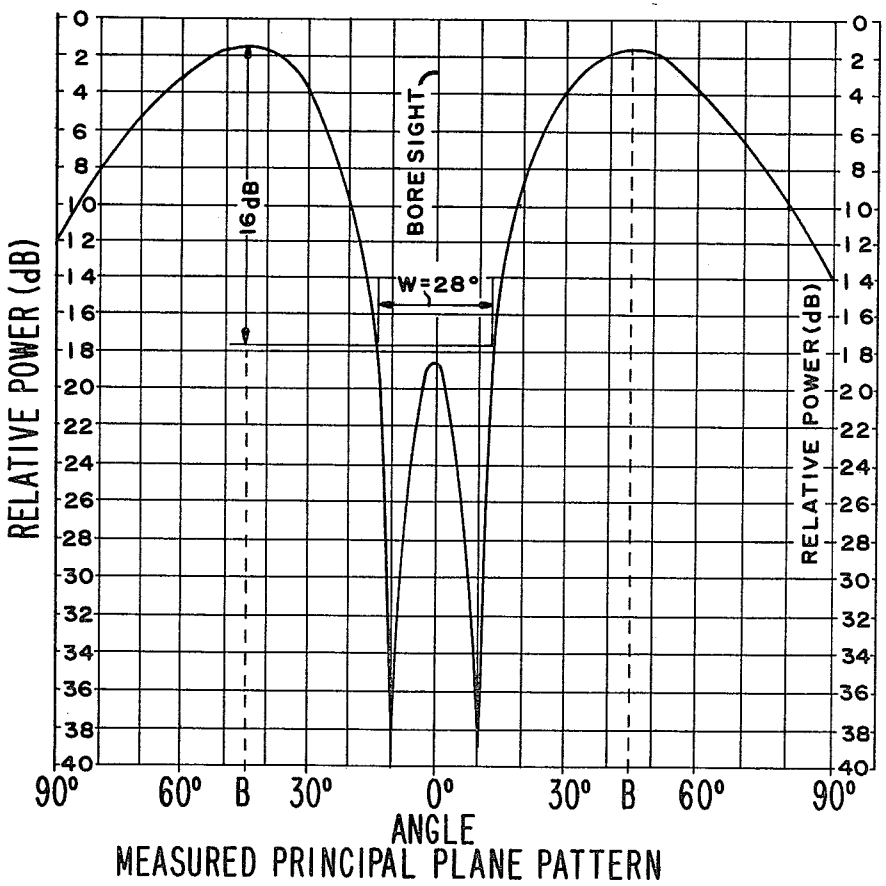
FIG. 5 is a graph showing measured results of the radiation pattern of the FIG. 1 antenna along a principal plane.

Antenna 1 produces a null along the boresight axis, as depicted in FIG. 5, which illustrates a measured radiation pattern of antenna 1 within a principal plane, which is any plane containing the boresight axis. The abscissa of FIG. 5 plots the angle formed by the boresight axis, the origin (the intersection of the boresight axis with the aperture), and the line connecting the origin with the point of measurement. All measurements were taken at points equidistant from the origin. The aperture is that plane orthogonal to cylinders 2 and 4 which lies midway (with respect to an axis parallel to the boresight) between the open ends of flares 6 and 8. Thus, when L6=L8 and A6=A8 (see FIG. 3) the plane of aperture touches the open ends of each of flares 6 and 8. L6 is the length of flare 6, L8 is the length of flare 8, A6 is the angle between flare 6 and an axis parallel to the boresight, and A8 is the angle between flare 8 and an axis parallel to the boresight, as illustrated in FIG. 3.

B is the angle at which the measured radiation is at maximum power. In general, the greater the value of n, the greater the value of B. It is normally desirable for B to be situated in the middle of the communications region of the radiation pattern (see FIG. 4, which also illustrates the pattern in a principal plane). Secondary influences on B are L6, L8, A6, A8, and the circumference of cylinder 4.

The width of the null region is defined as W (see FIG. 5), and is measured at a preselected power decrement below the peak of the major lobes.

The following cause a decrease in the value of W: (1) selecting a smaller n; (2) lengthening L8; (3) shortening L6; and/or (4) reducing A6 and A8. Similarly, the following cause an increase in the value of W: (1) selecting a larger n; (2) lengthening L8; (3) lengthening L6; and/or (4) increasing A6 and A8.

A6 and A8 can range between 0° and 90°, preferably between 0° and 45°. In the embodiment illustrated herein, A6 equals A8 equals approximately 45°, and L6 equals L8 equals approximately 0.4L. There is no minimum length limitation for L6 and L8, although no null shaping can occur if L6 and L8 are zero. There is no maximum length limitation on L6 and L8; however, after a certain length (approximately w, the width of the cavity formed between cylinders 2 and 4) additional lengthening of L6 and L8 will not change the radiation pattern of the antenna. This is because flares 6 and 8 serve to change the orientation of the propagating E vector. Whereas the E vector is initially orthogonal to each of cylinders 2 and 4, as the radiation propagates through the antenna, the E vector gradually changes orientation so that for long flares the E vector eventually is aligned orthogonal to each of flares 6 and 8.

h is the height of each of cylinders 2 and 4. If h is less than L/4 there is so much inductive loading that it is difficult to impedance match the antenna. On the other hand, one does not want h to be too great because increasing h will increase the weight and cost of the antenna.

As stated earlier, it is necessary for w to be less than L, because m equals 1. In the embodiment illustrated herein, w is approximately equal to L/8. If w becomes too small, the antenna becomes hard to impedance match.

Walls 2, 3, and 4 should be just thick enough to provide rigidity so as to minimize weight and materials usage.

Each probe consists of two flat electrically conductive strips bonded to dielectric 10: capacitive match 17 and radiating element 18. Each probe is preferably on the same side of its corresponding dielectric 10. Capacitive match 17 in the preferred embodiment has dimensions of 0.1L by 0.2L.

It is desired for radiating element 18 to be as long as possible, and thus a circular geometry is suitable as illustrated herein. Each probe terminates in center conductor 15 passing within feedthrough 12. Surrounding conductor 15 is hollowed-out dielectric cylinder 16, which provides electrical insulation between conductor 15 and conductive outer-threaded portion 13 of feedthrough 12, which is bonded to electrically conductive nut 14, which in turn is bonded to cylinder 4.

Figure 4:
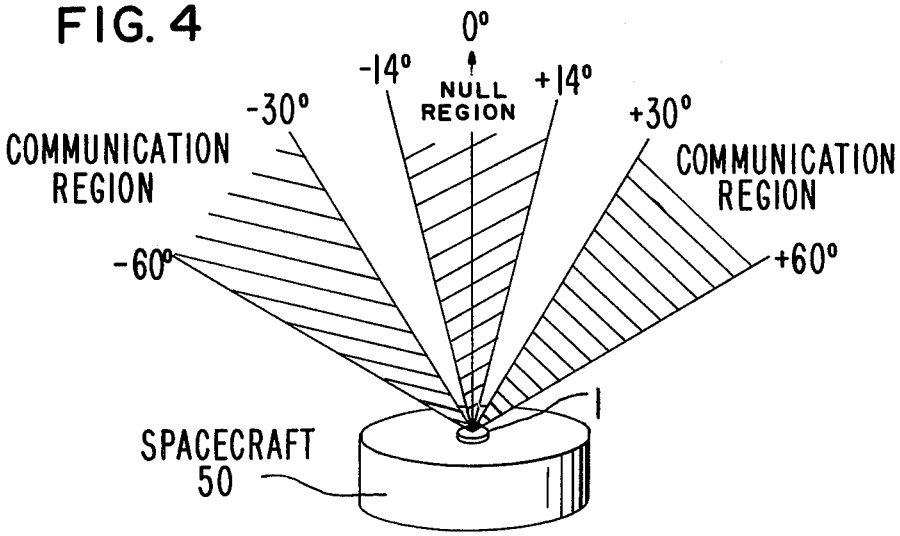
FIG. 4 is an elevational sketch of the antenna of FIG. 1 placed on board a spacecraft showing a two-dimensional projection of the resulting radiation pattern of the antenna.

FIG. 4 illustrates an application of antenna 1 radiating circularly polarized $TE_{31}$ radiation from a spacecraft 50. Antenna 1 is affixed to one of the faces of the spacecraft. There is a conical shaped null region along the boresight having an angular width of approximately 28°. Most of the energy is focused within a communication region occuring between 30° and 60°, i.e., the communication region has the shape of a 60° cone hollowed out by a 30° cone. The communication region could illuminate other spacecraft and the null region could encompass the earth, creating a zone of privacy between the spacecraft and the earth.

FIG. 5 illustrates that B is at approximately 45° for the circularly polarized $TE_{31}$ mode. The FIG. 5 measurements were taken with another antenna positioned within the opening of inner cylinder 2. The two antennas had very little effect on each other's pattern. The measurements were taken at a frequency just above the center frequency in the band of frequencies. The bandwidth was defined as that region where the null was at least 28° wide and the power within the null was at least 15 dB below the power at B. So defined, the bandwidth was greater than 11%.

Since the dimensions of the various components of antenna 1 are functions of L rather than absolute values, the antenna can be designed for use at any frequency, subject only to limitations of space for the low frequencies and limitations of precision at the high frequencies.

The above description is included to illustrate the operation of the preferred embodiments, and does not limit the scope of the invention. The scope of the invention is to be limited only by the following claims. From the above discussion, many variations will be apparent to one skilled in the art that would yet be encompassed by the spirit and scope of the invention.

What is claimed is:

1. A coaxial waveguide antenna for propagating electromagnetic radiation in the $TE_{n1}$ mode, where n is a positive integer greater than or equal to 3, comprising:
   an inner conductive cylindrical wall;
   coaxially aligned with said inner wall, an outer conductive cylindrical wall having a diameter greater than that of said inner wall, said two walls forming therebetween a cavity of generally toroidal shape;
   said cavity being closed on one end by a conductive ring, and open on a second end; and
   at least 2n excitation probes equally spaced radially within said cavity;
   wherein sinusoidal electromagnetic energy at a certain angular phase and the same frequency is applied to each of said probes;
   wherein the phase differences between each set of adjacent probes are equal; and
   said phase progresses through n 360° revolutions as said cavity is radially traversed once.

2. A coaxial waveguide antenna for propagating electromagnetic radiation in the $TE_{n1}$ mode, where n is a positive integer greater than or equal to 3, comprising:
   an inner conductive cylindrical wall; and
   coaxially aligned with said inner wall, an outer conductive cylindrical wall having a diameter greater than that of said inner wall, said two walls forming therebetween a cavity of generally toroidal shape;
   said cavity being closed on one end by a conductive ring, an open on a second end in the form of two flares extending radially outwardly, an inner flare connected to said inner wall and an outer flare connected to said outer wall; wherein
   the radiation propagates in a direction generally along the common longitudinal center axis of each of the two cylindrical walls; and
   the propagated radiation contains a null positioned generally along said center axis and shaped by the flares.

3. Apparatus of claim 2 wherein:
   the mean diameter of the two cylindrical walls is at least $nL/\pi$, where L is the free space wavelength of said radiation;
   the distance between the walls is less than L; and
   the axial length of each of said walls is greater than L/4.

4. Apparatus of claim 2 wherein each of said flares makes an angle of between 0° and 90° with the axialdirection of its associated cylindrical wall.

5. Apparatus of claim 2 wherein each of said flares makes an angle of between 0° and 45° with the axial direction of its associated cylindrical wall.

6. Apparatus of claim 2 further comprising:
   at least 2n excitation probes equally spaced radially within said cavity;
   wherein sinusoidal electromagnetic energy at a certain angular phase and the same frequency is applied to each of said probes;

the phase differences between each set of adjacent probes are equal;

said phase progresses through n 360° revolutions as said cavity is radially circumnavigated; and said ensuing radiation is linearly polarized.

7. A coaxial waveguide antenna for propagating electromagnetic radiation in the $TE_{n1}$ mode, where n is a positive integer greater than or equal to 2, comprising:

an inner conductive cylindrical wall; and coaxially aligned with said inner wall, an outer conductive cylindrical wall having a diameter greater than that of said inner wall, said two walls forming therebetween a cavity of generally toroidal shape;

said cavity being closed on one end by a conductive ring, and open on a second end in the form of two flares extending radially outwardly, an inner flare connected to said inner wall and an outer flare connected to said outer wall;

said antenna further comprising:

at least 4n excitation probes equally spaced radially within said cavity;

wherein sinusoidal electromagnetic energy at a certain angular phase and the same frequency is applied to each of said probes;

the phase differences between each set of adjacent probes are equal;

said phase progresses through n 360° revolutions as said cavity is radially circumnavigated; and said ensuing radiation is circularly polarized.

8. A method for shaping the null in the radiation pattern of a coaxial waveguide antenna comprising the steps of:

building a coaxial waveguide antenna toroidal cavity for exciting a $TE_{n1}$ mode, where n is a positive integer $\geqq 2$;

flaring an open end of said cavity radially outwardly by means of an inner and an outer flare connected respectively to inner and outer coaxial cylindrical walls that surround said cavity;

wherein said radiation emanates generally along the axis of revolution of said cylindrical walls, in the direction of said flared end;

wherein a conical null is produced in the radiation pattern along said axis of revolution;

wherein the width of said null can be increased by performing at least one of the following substeps:

increasing n;

shortening the outer flare;

lengthening the inner flare;

increasing the angles formed by each flare and a line parallel to said axis of revolution.

* * * * *